US005904054A

United States Patent [19]

Lee

[11] Patent Number: 5,904,054

[45] Date of Patent: May 18, 1999

[54] APPARATUS FOR SUPPLYING WATER TO AN ICE TRAY OF A REFRIGERATOR

[75] Inventor: Yong-Kweon Lee, Incheon, Rep. of Korea

[73] Assignee: Daewoo Electronics Co., Ltd., Seoul, Rep. of Korea

[21] Appl. No.: 08/955,464

[22] Filed: Oct. 21, 1997

[30] Foreign Application Priority Data

Oct. 21, 1996 [KR] Rep. of Korea ..... 96-47276

[51] Int. Cl.[6] ..... F25C 1/12

[52] U.S. Cl. ..... 62/347; 137/624.13; 222/504

[58] Field of Search ..... 62/347; 137/624.13; 141/238; 222/146.6, 504

[56] References Cited

U.S. PATENT DOCUMENTS 4,821,921 4/1989 Cartwright et al. ..... 222/504

4,921,131 5/1990 Binderbauer et al. ..... 222/504

5,555,743 9/1996 Hatanaka ..... 62/347

*Primary Examiner*—William E. Tapolcai

*Attorney, Agent, or Firm*—Pillsbury Madison & Sutro LLP

[57] ABSTRACT

Apparatus for supplying an exact quantity of a water to an the ice tray is provided. The apparatus includes a first container having a same volume as the ice tray and being rotatably installed below the water tank, and a valve unit for opening and closing the water tank. A driving member for rotating the first container and at the same time, raising and lowering the valve unit is provided. A water supply member is installed in a partition wall which partitions off the freezing and refrigerating compartments. The water supply member flows water from an outlet pipe of a second container to the ice tray. At first, water is supplied to the first container, and then water supplied to the first container is supplied to the ice tray. Therefore, an exact amount of water is supplied to the ice tray.

17 Claims, 8 Drawing Sheets

APPARATUS FOR SUPPLYING WATER TO AN ICE TRAY OF A REFRIGERATOR

BACKGROUND OF THE INVENTION

1. Field of the Invention

The present invention relates to an apparatus for automatically supplying an exact amount of water to an ice tray provided in a refrigerator.

2. Description of the Prior Art

In general, a refrigerator includes a water supplying apparatus which supplies a water to an ice tray which is disposed in a refrigerating compartment of the refrigerator. Hereinafter, a refrigerator having a conventional water supply device be explained. FIG. 8 shows the structure of a conventional water supply device. As shown in FIG. 8, a refrigerator has a freezing compartment and a refrigerating compartment 110 which is arranged above the freezing compartment 115. A water tank 6 and a water container 2 are interconnected with each other, and are contained in the refrigerating compartment 110. An ice tray 5 for making ice cubes is provided in the freezing compartment 115. The water container 2 has a partition plate 4 which partitions the inner of the water container 2 into a first chamber 2*a* and a second chamber 2*b*. The partition plate 4 has a hole 4*a* for communicating the first chamber 2*a* and the second 2*b* with each other. The first chamber 2*a* communicates with the water tank, and the second chamber 2*b* communicates with the ice tray 5 by a water supply pipe 8. A pump 3 is provided in the refrigerating compartment 110 for pumping water contained in the second chamber 2*b* to the ice tray 5. Reference numeral 7 in the FIG. 8 denotes a valve unit for opening and closing the communicated port 6*a* of the water tank 6 and the first chamber 2*a*.

In the conventional apparatus for supplying water as described above, the water which is contained in the water container 2 is supplied to the ice tray 5 by the driving force of the pump 3. However, the conventional apparatus for supplying water doesn't have a sensing device for sensing a quantity of water which is supplied to the ice tray 5. Therefore, the water can overflow from the ice tray 5 when a lot of water is supplied to the ice tray 5, and an ice having a smaller size than a required size can be made when little water is supplied to the ice tray 5.

Further, in order to sense a quantity of the water which is supplied to the ice tray 5, there must be additionally provided a sensing device, which heightens the cost of the apparatus for supplying water.

Also, U.S. Pat. No. 5,555,743 issued to Hidehara Hatanaka et al. discloses an apparatus for supplying water to an automatic ice making apparatus. However, in Hidehara Hatanaka et al.'s apparatus, since the refrigerating compartment and the freezing compartment are always communicated with each other by the water supply route, the cooling air may flow from the freezing compartment to the refrigerating compartment.

SUMMARY OF THE INVENTION

Therefore, it is an object of the present invention to provide an exact for supplying water to an ice tray of a refrigerator which can automatically supply an accurate quantity of water to the ice tray without the above described problems and disadvantages.

In order to achieve the above-mentioned object of the present invention, there is provided an apparatus for supplying water from a water tank to an ice tray, the water tank being provided in a refrigerating compartment of a refrigerator, the ice tray being provided in a freezing compartment of the refrigerator, and the refrigerating compartment being positioned above the freezing compartment. The apparatus includes a first container for measuring a quantity of water, the first container having a same volume as the ice tray, the first container having an outlet port formed at the bottom surface thereof, the first container being rotatably installed below the water tank, and the outlet port being interconnected with a lower portion of the water tank; a second container for supporting the first container which is installed in the freezing compartment, the second container including an outlet pipe which is formed at a bottom surface thereof and which is interconnected with the outlet port of the first container when the first container is being rotated; a valve unit for opening and closing the lower portion of the water tank, the valve unit being raised and lowered and supplying an exact amount of water from the water tank to the first container; a driving means for simultaneously rotating the first container, and raising and lowering the valve unit so that the driving means interconnects and shuts the outlet port of the first container and the outlet pipe of the second container with/from each other; and a water supply member being installed in a partition wall which partitions off the freezing and refrigerating compartments, and for flowing water from the outlet pipe of the second container to the ice tray.

The apparatus for supplying water according to the present invention includes a first container having a same volume as the ice tray. The water is supplied from the water tank to the first container when the valve unit is raised. The water is supplied from the first container to the ice tray when the outlet port of the first container and the outlet pipe of the second container are interconnected with each other. These operations are performed by the driving means. The water supply member supplies water from a first container to the ice tray and prevents a cooling air from flowing from the freezing compartment to the refrigerating compartment.

The apparatus for supplying water according to the present invention is provided in the first container having a same volume as the ice tray. At first, water is supplied to the first container, and the water supplied to the first container is supplied to the ice tray. Therefore, an exact amount of a water is supplied to the ice tray.

BRIEF DESCRIPTION OF THE DRAWINGS

The above object and other advantages of the present invention will become more apparent by describing in detail a preferred embodiment thereof with reference to the attached drawings, in which.

DETAILED DESCRIPTION OF THE INVENTION

Hereinafter, an apparatus for supplying water to an ice tray of a refrigerator according to a preferred embodiment of the present invention is explained in more detail with reference to the accompanying drawings.

Figure 1:
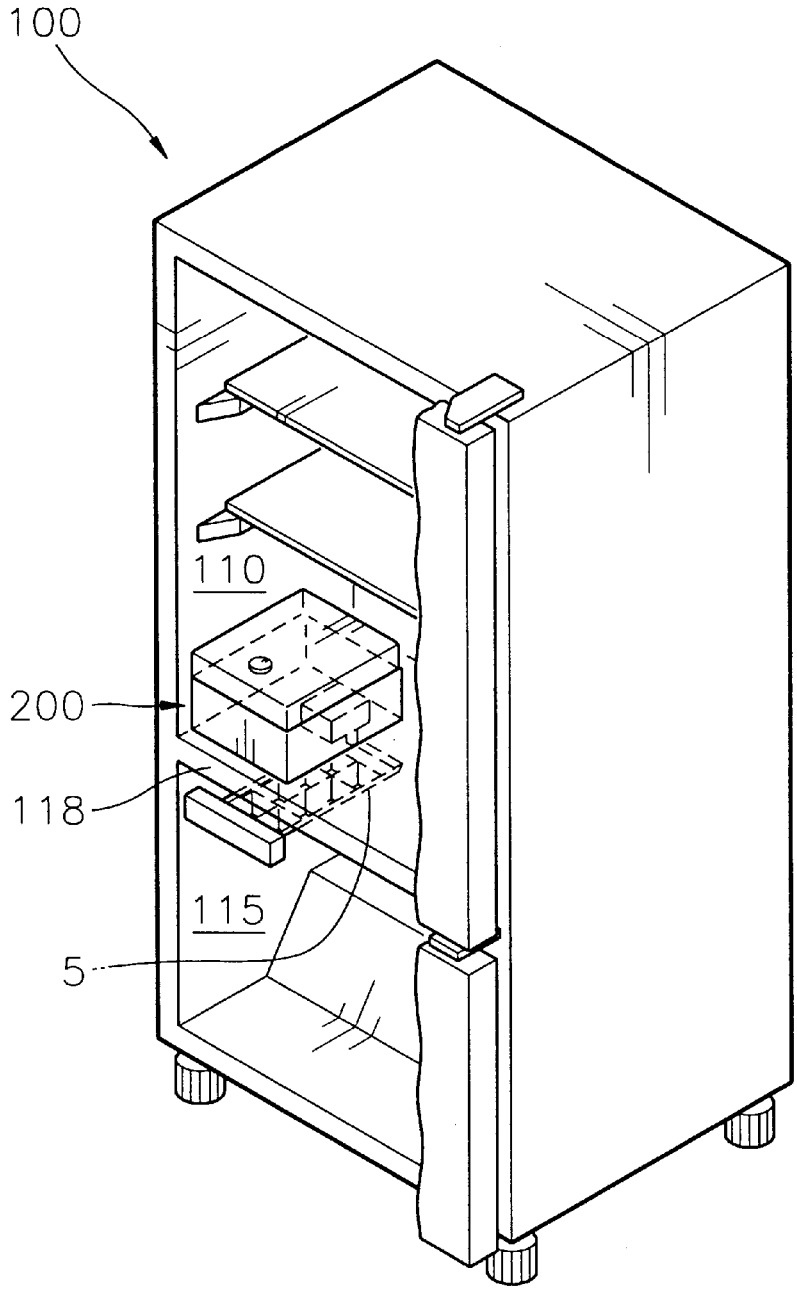
FIG. 1 is a perspective view of a refrigerator according to one embodiment of the present invention.

FIG. 1 is a perspective view of a refrigerator according to a preferred embodiment of the present invention. As shown in FIG. 1, the inner space of the refrigerator 100 is partitioned into a refrigerating compartment 110 and a freezing compartment arranged below the refrigerating compartment 115 by partition wall 118. The freezing compartment 115 is equipped with an ice tray 5 and the refrigerating compartment 110 is equipped with an apparatus 200 for supplying water. The reason why the refrigerating compartment 110 is located above the freezing compartment 115 is that water is supplied to the ice tray 5 by gravity.

Figure 2:
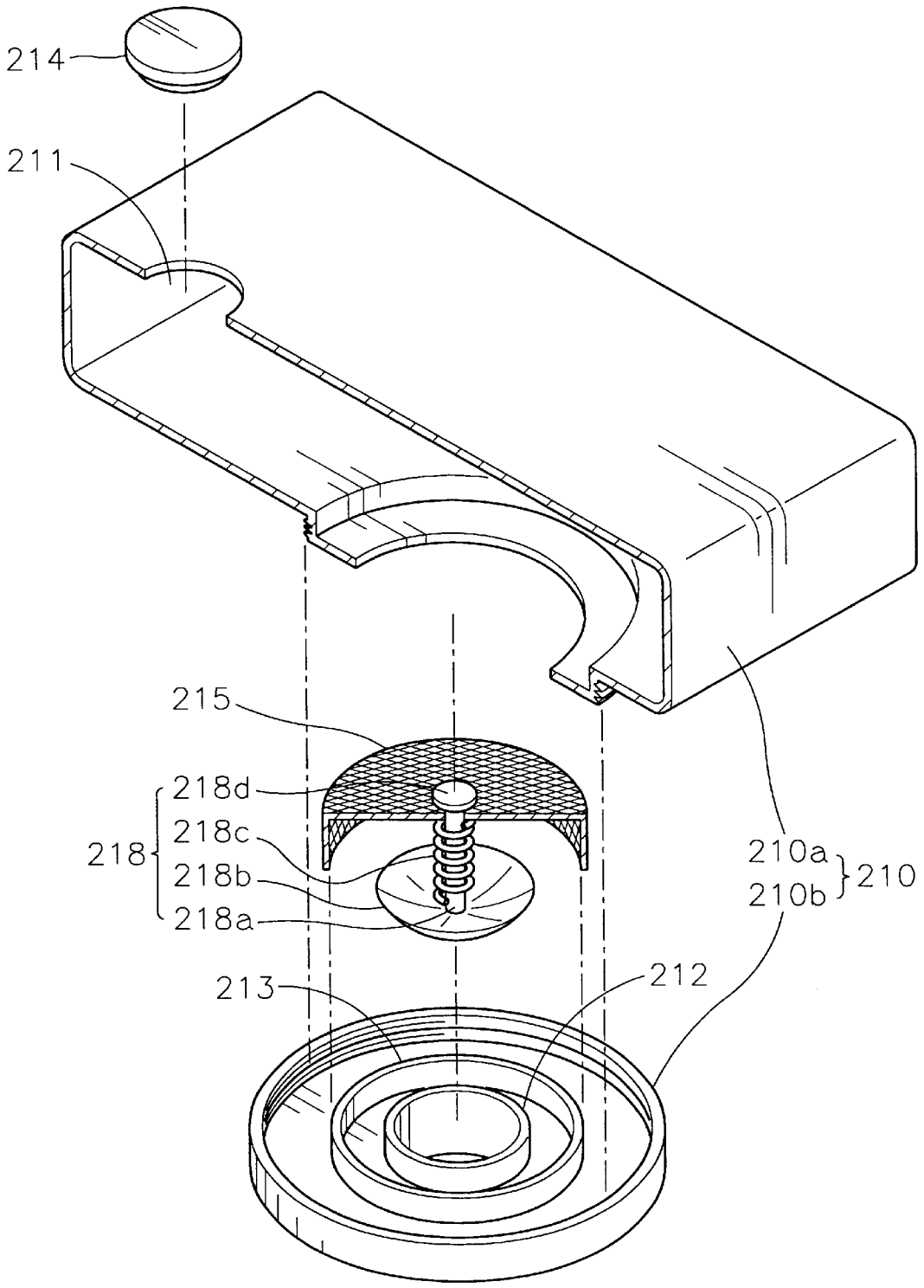
FIG. 2 is a partially disassembled perspective view of a water tank of the apparatus shown in FIG. 1.
Figure 5:
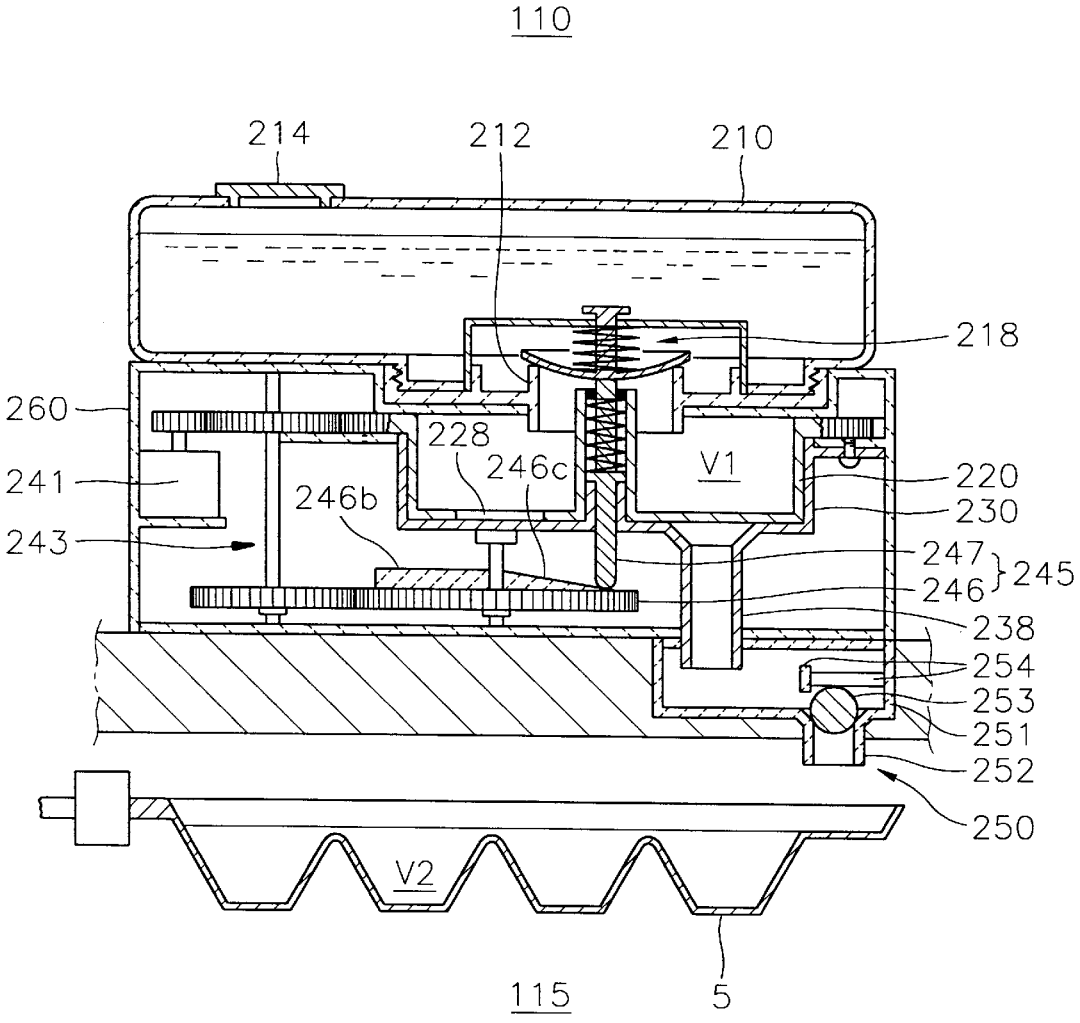
FIG. 5 is a longitudinal sectional side view of the apparatus shown in FIG. 1.

The water supplying apparatus 200 includes a water tank 210. The water tank 210 is explained in more detail with reference to FIGS. 2 and 5. FIG. 2 is a partially exploded perspective view of a water tank of the water supplying apparatus 200 shown in FIG. 1, and FIG. 5 is a longitudinal sectional side view of a water supplying apparatus 200 shown in FIG. 1.

The water tank 210 includes a top case 210*a* and a bottom case 210*b* which is joined with the top case 210*a*. An inlet port 211 which is opened and closed by a cork 214 is formed at an upper surface of the top case 210*a*, so that water flows into the water tank 210 through the inlet port 211. A discharge cylindrical member 212 which is extended upward and downward is formed at a lower surface portion of the bottom case 210*b*, so that the water contained in the water tank 210 is discharged through the discharge cylindrical member 212. The water tank 210 further includes a filter 212 for filtering impurities contained in the water of the water tank 210 when the water is discharged from the water tank 210. The filter 212 is fitted with a rib 213 of a circle type which surrounds the discharge cylindrical member 212 of the bottom case 210*b*.

A valve unit 218 is installed in the water tank 210, and ascends and descends for opening and closing the discharge cylindrical member 212, respectively. The valve unit 218 has a shaft 218*a* passing through the filter 215, and a plate 218*b* formed at the bottom end of the shaft 218*a*. The plate 218*b* is ascended and descended by a driving member (explained later), so that the plate 218*b* opens or closes the discharge cylindrical member 212*b*, respectively. Also, the valve unit 218 has an elastic member 218*c* such as a compression coil spring between the plate 218*b* and the filter 215. The elastic member 218*d* pushes down the plate 218*b* toward the discharge cylindrical member 212. Therefore, the discharge cylindrical member 212 is closed in normal state by the plate 218*b*, because the plate 218*b* makes contact with the discharge cylindrical member 212. Also, the valve unit 218 having the shaft 218*a* returns to the initial position by the expansive force of the elastic member 218*d*. The valve unit 218 also has a stopper 218*d* formed at the top end of the shaft 218*a*, which prevents the shaft 218*a* passing through the filter 215 from being separated from the filter 215.

Figure 3:
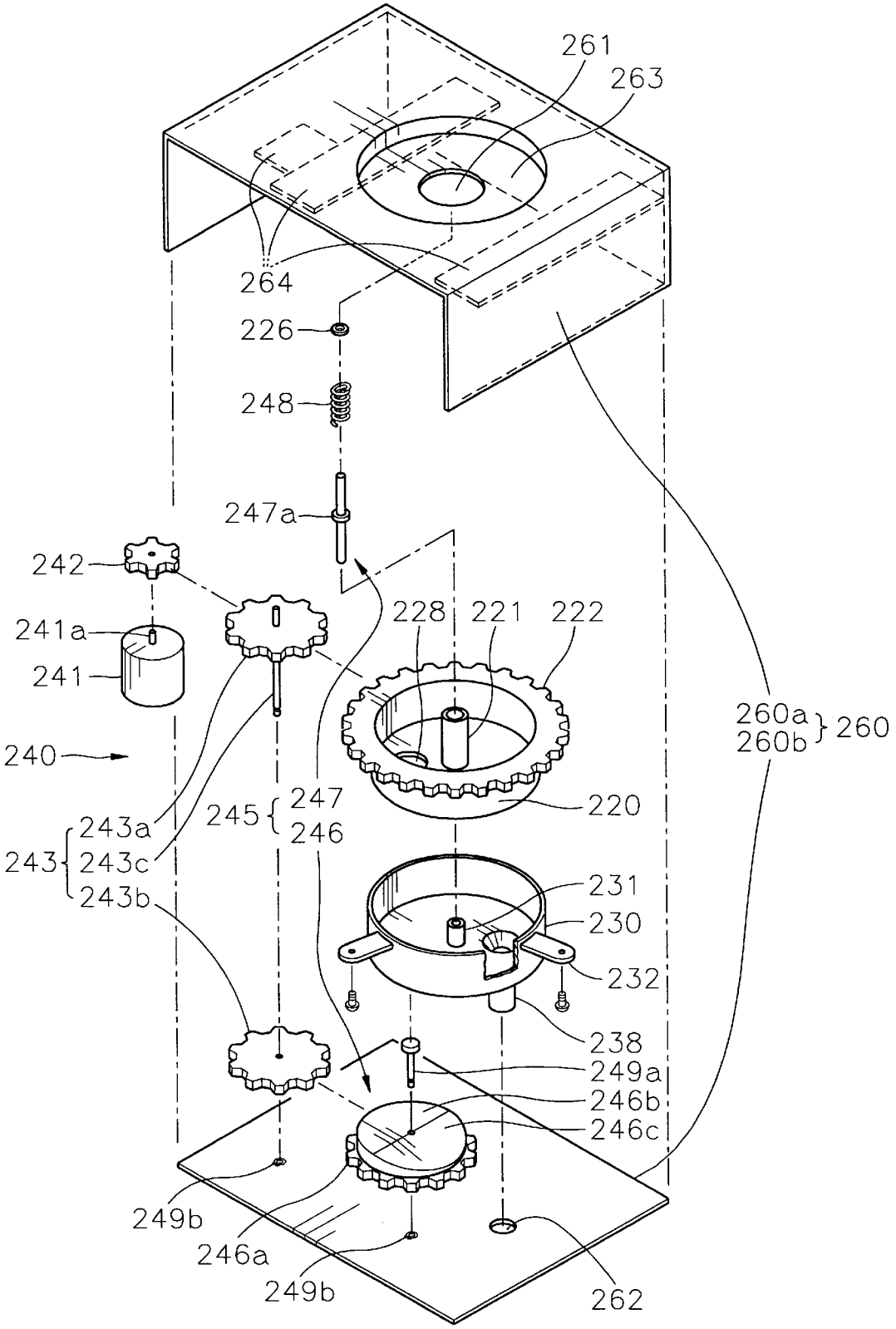
FIG. 3 is a partially exploded perspective view of a supporting member and elements provided in the supporting member of the apparatus shown in FIG. 1.

A supporting member 260 which is installed in the refrigerating compartment 210 of the refrigerator 100 supports the water tank 210. The supporting member 260 and the elements provided in the supporting member 260 will be explained in more detail with reference to the FIGS. 3 and 5. FIG. 3 is a partially exploded perspective view of the supporting member and elements provided in the supporting member of the water supplying apparatus 200 shown in FIG. 1, and FIG. 5 is a longitudinal sectional side view of the apparatus for supplying water shown in FIG. 1.

A first container 220 for supplying a proper quantity of water to the ice tray 5 which is supplied with water from the water tank 210 and a second container 230 for supporting the first container 220 are provided in the supporting member 260. The first container 220 and second container 230 are arranged for controlling the supplying of water from the first container 220 to the ice tray 5. This operation is performed by the rotation of the first container 230. Also, a driving member 240 for rotating the first container 220 is installed in the supporting member 260. In order to supply the water contained in the water tank 210 to the first container 220, the water tank 210 and the discharge cylindrical member 212 of the water tank 210 are interconnected with the first container 220. Namely, the discharge cylindrical member 212 is interconnected with the first container 220, the discharge cylindrical member 212 is opened and closed by the valve unit 218 being ascended and descended by the driving member 240.

First, the supporting member 260 will be explained. The supporting member 260 has a frame 260*a* and base plate 260*b*. An upper penetration hole 261 which is communicated with the discharge cylindrical member 212 is formed at an upper surface of the frame 260*a*, a lower penetration hole 262 which is communicated with an outlet pipe 238 (which is explained later) is formed at the base plate 260*b*. A recessed portion 263 is formed surrounding the upper penetration hole 261 of the supporting member 260. The discharge cylindrical member 212 of the water tank 210 is fitted with the recessed portion 263. Therefore, the water tank 210 is not movable, that is, is securely fixed on the supporting member 260. Also, supporting plates 264 is provided in the frame 260*a*. The supporting plates 261 supports the first container 220 and driving member 240.

The first container 220 which is communicated with the upper penetration hole 261 of the water tank 260 is installed in the supporting member 260. Since the discharge cylindrical member 212 of the water tank 210 passes through the upper penetration hole 261, the first container 260 is communicated with the water tank 210. The volume V1 of the first container 220 is equal with the volume V2 of the ice tray 5 (refer to FIG. 5), so that an exact amount of water may be supplied to the ice tray 5 (explained later). A supporting pipe 221 is formed at the central portion of the first container 220. In the supporting pipe 221, is located a ascending/descending bar 247 of the driving member 240. The ascending/descending bar ascends and descends the valve unit 218. A sealing member 226 for preventing water from flowing into the supporting pipe 221 is fixed to an upper inner portion of the supporting pipe 221. The ascending/descending bar 247 passes through the sealing member 226 to descend and to ascend. A first gear 222 is formed at the upper portion outside the first container 220, and is engaged with a motor 241 of the driving member 240.

The second container 230 for supporting the first container 220 is installed in the supporting member 260. More particularly, the second container 230 is fixed to the supporting member 260, the first container 220 is rotatably installed inside the second container 230. An insert pipe 231 is provided at the center of the inside of the second container 230, is inserted into the supporting pipe 221 of the first container 220. Brackets 234 are provided at the outside of the second container 230. The brackets 234 are fixed to the supporting plates 264 of the supporting member 260. Therefore, the second container 230 is fixed to the supporting member 260.

A inlet port 228 is formed at the bottom surface of the first container 220, and an inlet pipe 238 is provided at the bottom surface of the second container 230. The inlet port 228 and the inlet pipe 238 is communicated with and shut from each other by the rotation of the first container 220. Therefore, the water which is contained in the first container 220 is supplied to the ice tray 5 and the supplying of water to the ice tray 5 is stopped.

The above described operation is performed by the rotation of the first container 220. The water supplying apparatus includes the driving member 240. The driving member 240 rotates the first container 220, at the same time ascends and descends the valve unit 218. Namely, the driving member 240 communicates with the inlet port 228 and the inlet pipe 238 each other, and shuts from the inlet port 228 and the inlet pipe 238 each other.

The driving member 240 has a motor 241 which is controlled by a controller (not shown) which is provided in a the refrigerator 100 and rotates the first container 220, and has a movement converting member 243 which is rotated by the motor 241, for raising and lowering the valve unit 218. Hereinafter, the driving member will be explained.

The motor 241 includes a shaft 241*a* having a second gear 242 as a driving gear. A movement transmission member 243 is located between the second gear 242 of the motor 241 and the first gear 222 of the first container 220. The movement transmission member 243 has a third gear 243*a*, a fourth gear 243*b*, and a connecting shaft 243*c* for connecting the third gear 243*a* to the fourth gear 243*b*. The third gear 243*a* transmits the turning force of the second gear 242 which is rotated by the motor 241 to the first gear 222 of the first container 220. Therefore, the first container 220 is rotated by the third gear 243*a*. The third gear 243*a* and the fourth gear 243*b* are rotated simultaneously, and the fourth gear 243*b* operates the movement converting member 243. Namely, the movement transmission member 243 which is rotated by the motor 241 rotates the first container 220 and synchronously operates the movement converting member 245.

The movement converting member 245 has a rotating plate 245 rotated by the fourth gear 243*b*, an ascending/descending bar 247 which is ascended and descended by making contact with the rotating plate 246. A fifth gear 246*a* is formed at an outer peripheral portion of the rotating plate 246. The top surface of the rotating plate 246 is sloped. In more detail, a plane surface 246*b* is formed at half of the top surface of the rotating plate 246, and a slope surface 246*c* which is sloped in a downward direction toward the outside of the rotating plate 246 is formed at the other half of the top surface of the rotating plate 246. The plane surface 246*b* starts from the highest position of the sloped surface 246*c*. A bottom end of the ascending/descending bar 247 makes contact with the top surface of the rotating plate 246. Also, a top end of the ascending/descending bar 247 passes through the insert pipe 231 and the sealing member 226, and makes contact with the plate 218*b* of the valve unit 218. As the rotating plate 246 rotates, the ascending/descending bar 247 ascends and descends while the ascending/descending bar initially makes contacts the slope surface 246*c* and then with the plane 246*b*. A rim 247*a* is formed at a circumference of the ascending/descending bar 247, and is located in a lower position of the sealing member 226. A compression coil spring 248 such as an elastic member is installed between the rim 247*a* and the sealing member 226. Since the compression coil 248 pushes down the rim 247*a* toward the rotating plate 246, the bottom end of the ascending/descending bar 247 makes contact with the top surface of the rotating plate 246. Namely, the ascending/descending bar 247 is raised by the rotating plate 246, returns to an initial position by the force of the compression coil spring 248. Also, the ascending/descending bar 247 returns to the initial position by gravity. Reference numeral 249*b* denotes a fin for joining the rotating plate 246 to the second container 230, and Reference numeral 249 denotes a washer.

In the refrigerator 100 according to the present invention, the refrigerating compartment 110 is located above the freezing compartment 115. The refrigerating compartment 110 and the freezing compartment 118 are partitioned by the partition wall 118. In order to interconnect the first container 220 installed in the refrigerating compartment 110 with the ice tray 5 installed in the freezing compartment 118, a water supply member 250 is inserted through the partition wall 118.

Figure 4:
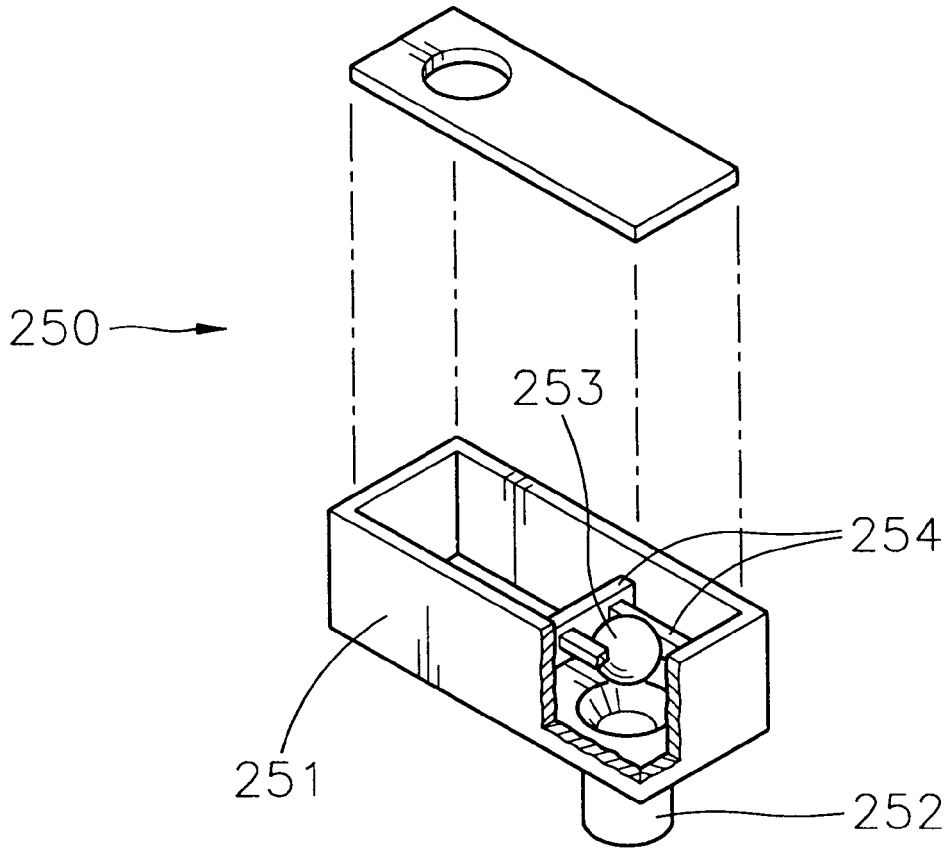
FIG. 4 is a partially disassembled perspective view of a water supply member of the apparatus shown in FIG. 1.

The water supply member 250 will be explained in more detail with reference to the FIGS. 4 and 5. FIG. 4 is a partially disassembled perspective view of a water supply member shown in FIG. 1.

The water supply member 250 has a first supply pipe 251 which is interconnected with the inlet pipe 238 of the second container 230, and has a second supply pipe 252 for supplying water which is contained in the first supply pipe 251 to the ice tray 5. The second supply pipe 252 expands from the first supply pipe 251 to the ice tray 5. A cooling air contained in the freezing compartment 115 may be introduced into the refrigerating compartment 110 since the freezing compartment 118 is interconnected with the refrigerating compartment 110 by the water supply member 250. In order to prevent the cooling air from flowing from the freezing compartment 118 to the refrigerating compartment 110, the flow path of the water supply member 250 should be closed when a water is not being supplied from the water supply member 250 to the ice tray 5. In order to close the flow path of the water supply member 250, a sectional area of the second supply pipe 252 is smaller than that of the first supply pipe 251 and a floater 253 having a ball shape is installed in the first supply pipe 251. The floater 253 floats and sinks by according to a water level, and the diameter of the floater 253 is a larger than that of the second supply pipe 252. Therefore, the floater 253 does not go into the second supply pipe 252. As the water which has been supplied from the water tank 210 to the first container 220 is introduced into the first supply pipe 251 of the water supply member 250, the floater 253 ascends by buoyancy. As the water which is contained in the first supply pipe 251 is supplied to the second supply pipe, the floater 253 descends. Therefore, the water contained in the first supply pipe 251 may be supplied to the ice tray 5 through the second supply pipe 252.

When a movement range of the floater 253 is not limited, the floater 253 doesn't fully shut an interconnecting port of the first supply pipe 251 and the second supply pipe 252. For limiting the movement range, the water supply member 250 further has a guiding bar 254. The guiding bar 254 is positioned directly above the interconnecting port of the first supply pipe 251 and the second supply pipe 252. Namely, the guiding bar 254 restricts a movement range of the floater 253 so that the floater 253 floats and sinks directly above the interconnecting port of the first supply pipe 251 and the second supply pipe 252. Therefore, the floater 253 fully shuts the interconnecting port of the first supply pipe 251 and the second supply pipe 252.

Figure 6:
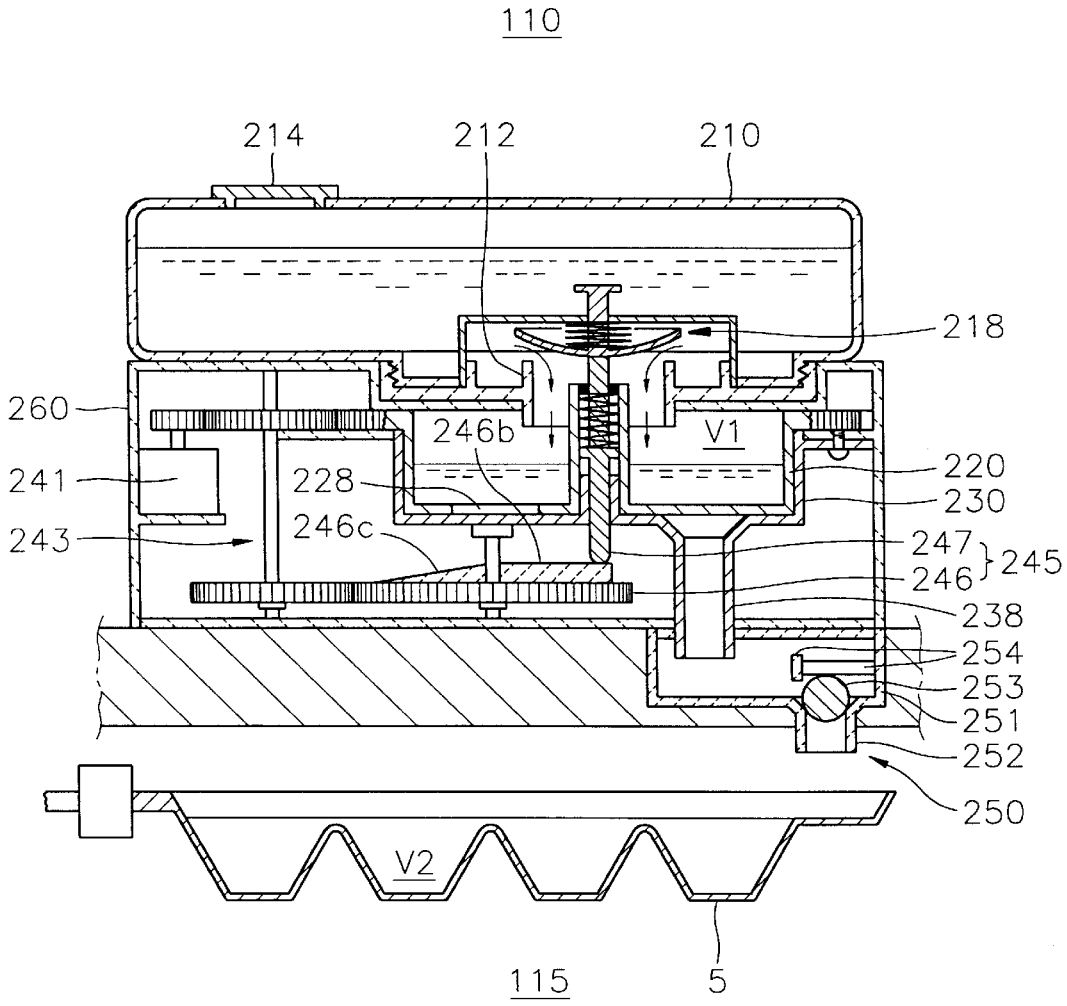
FIGS. 6 and 7 are sectional side views of the apparatus shown in FIG. 1 for explaining an operation thereof.
Figure 7:
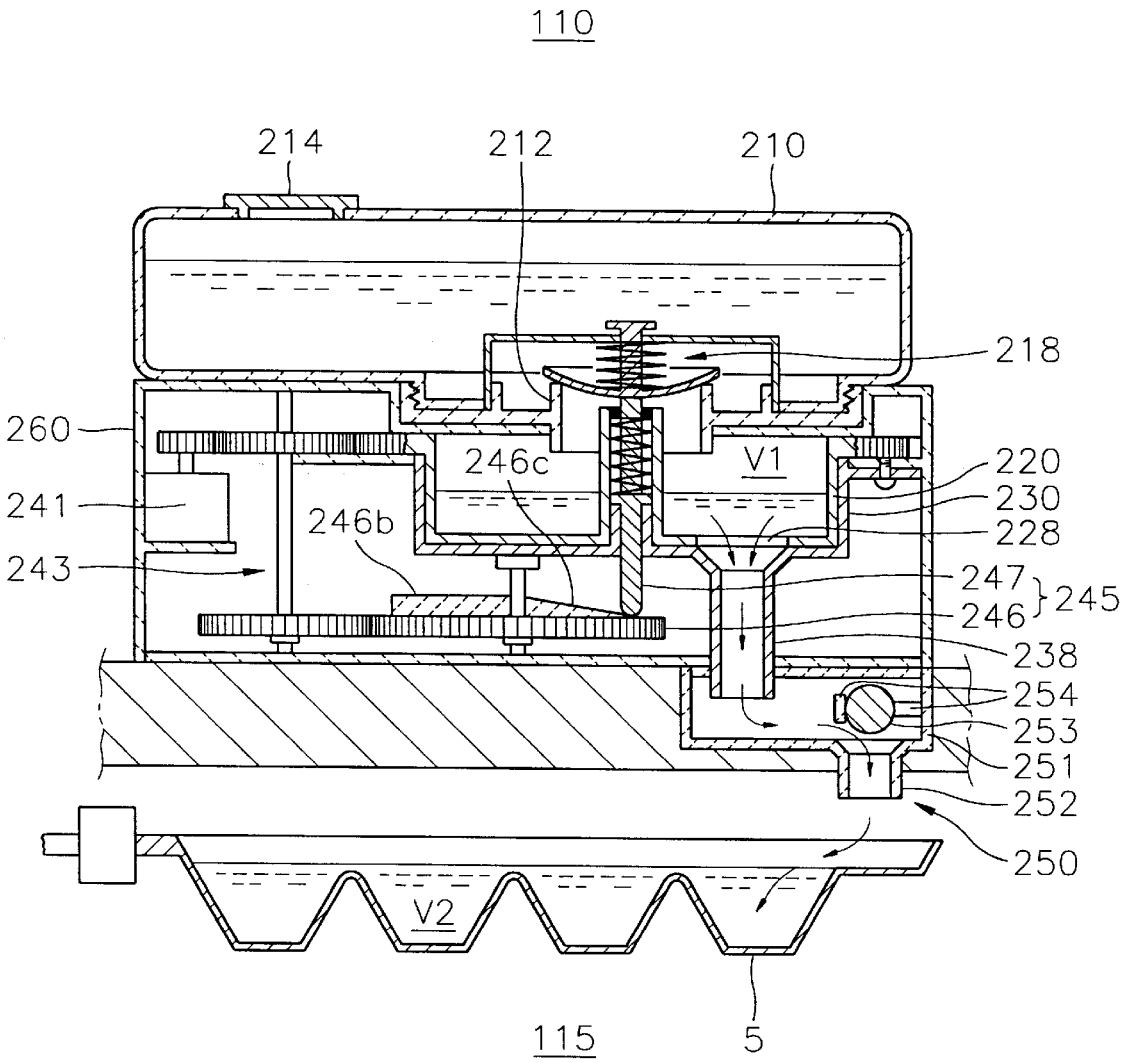
Figure 8:
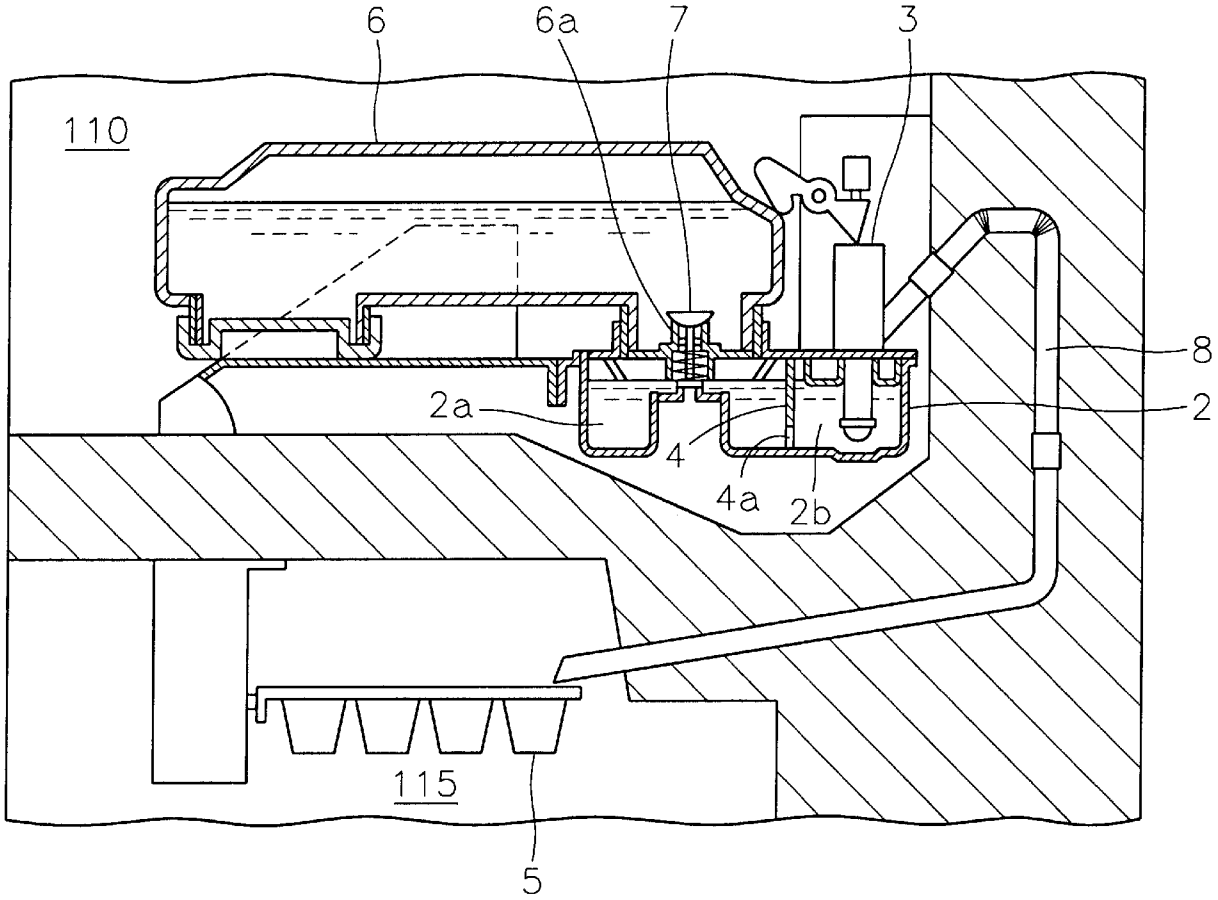
FIG. 8 (PRIOR ART)
FIG. 8 is a longitudinal sectional side view of a conventional water supply device.

The operations of the apparatus for supplying water according to the present invention will be briefly explained with reference to FIGS. 5 to 7. FIG. 5 is a longitudinal sectional side view of the apparatus shown in FIG. 1, FIGS. 6 and 7 are a sectional side view of the apparatus for supplying water for explaining to the an operation thereof shown in FIG. 1.

An initial state is that the inlet port 228 of the first container 220 is not communicated with the inlet pipe 238 of the second container 230, and the bottom end of the ascending/descending bar 247 makes contact with the slope surface 246*c* of the movement converting member 245. The process for supplying the water contained in the water tank 210 to the first container 220 will be explained from the initial state.

If the motor 241 is rotated by a controller (not shown), the movement transmission member 243 is rotated. Also, the first container 220 and the rotating plate 246 of the movement converting member 245 are synchronously rotated by the movement transmission member 243. Therefore, the ascending/descending bar 247 which makes contact with the slope surface 246*c* gradually makes contacts with the plane 246*b*. At this time, the valve unit 218 ascends. Then, the discharge cylindrical member 212 of the water tank 210 is opened, and the water which is contained in water tank 210 is supplied to the first container 220 (refer FIG. 6).

Thereafter, when the ice tray 5 needs a water-supply, the motor 241 is again operated by a controller. Then, the first container 220 is rotated and the inlet port 228 of the first container 220 is communicated with the inlet pipe 238 of the second container 230. Therefore, the water which is contained in the first container 200 flows into the first supply pipe 251 of the water supply member 250. When the water flows into the first supply pipe 251, the floater 253 floats so that the water may be supplied to the ice tray 5 through the second supply pipe 252. Because the volume V1 of the first container 220 is equal to the volume V2 of the ice tray 5, the water is precisely supplied to the ice tray 5. As the water which has been supplied to the first supply pipe 251 is supplied to the ice tray 5, the floater 253 sinks. The process of the supplying water is completed, and the communicating port of the first supply pipe and the second supply pipe is shut by the floater 253.

The above described operations are repeatedly performed. More particularly, when the water which is contained in the water tank 210 flows in the first container 220, the inlet port 228 is communicated with the inlet pipe 238. In this case, more water is supplied to the ice tray 5 than the required quantity of water. In order to prevent this, the revolution per speed of the motor 241 is controlled. That is, the communicating time of the inlet port 228 and the inlet pipe 238 is controlled by the controller.

As above-described, the water supplying apparatus according to the embodiment of the present invention is provided in the first container having a same volume with the ice tray. Water is supplied to the first container first, and water which is contained in the first container is supplied to the ice tray. Therefore, an exact amount of water is supplied to the ice tray.

Although the preferred embodiment of the invention has been described, it is understood that the present invention should not be limited to this preferred embodiment, but various changes and modifications can be made by one skilled in the art within the spirit and scope of the invention as hereinafter claimed.

What is claimed is:

1. An apparatus for supplying water from a water tank to an ice tray, the water tank being provided in a refrigerating compartment of a refrigerator, the ice tray being provided in a freezing compartment of the refrigerator, the refrigerating compartment being positioned above the freezing compartment, the apparatus comprising:

a first container for measuring a quantity of water, the first container having a same volume as the ice tray, the first container having an outlet port formed at a bottom surface thereof, the first container being rotatably installed below the water tank, and the outlet port being interconnected with a lower portion of the water tank;

a second container for supporting the first container which is installed in the freezing compartment, the second container including an outlet pipe which is formed at a bottom surface thereof and is interconnected with an outlet port of the first container when the first container is rotated;

a valve unit for opening and closing a lower portion of the water tank, the valve unit being capable of raising, lowering, and supplying an accurate amount of water from the water tank to the first container;

a driving means for rotating the first container while raising and lowering the valve unit so that the driving means interconnects and shuts the outlet port of the first container and the outlet pipe of the second container with/from each other; and a water supply member installed in a partition wall which partitions the freezing and refrigerating compartments, for allowing water to flow from the outlet pipe of the second container to the ice tray.

2. The apparatus of claim 1, wherein the water tank comprises a filter for filtering impurities.

3. The apparatus of claim 2, wherein the valve unit comprises:

a shaft extending from the filter to an upper position of the first container, the shaft being raised and lowered by the driving means;

a plate formed at a bottom end of the shaft for opening and closing the lower portion of the water tank;

a stopper formed at a top end of the shaft for preventing the shaft from being parted from the filter; and an elastic member located between the filter and the plate.

4. The apparatus of claim 1, wherein the driving means comprises:

a motor positioned in the refrigerating compartment and controlled by a controller;

a movement transmission member for rotating the first container by a driving force of the motor; and a movement converting member for changing a rotatory motion of the motor into a linear motion of the movement transmission member to raise and lower the valve unit.

5. The apparatus of claim 4, wherein a first gear is formed at a side surface of the first container for engaging the first container with the movement transmission member.

6. The apparatus of claim 5, wherein the movement transmission member comprises:

a third gear engaged with the motor and the first gear of the first container;

a fourth gear for rotating the movement converting member by the first gear being rotated; and a connecting shaft for connecting the third gear and the fourth gear with each other.

7. The apparatus of claim 4, wherein a supporting pipe for supporting the movement converting member is formed from the first container toward the lower portion of the water tank, and an insert pipe for insertion into the supporting pipe is formed in the second container.

8. The apparatus of claim 7, wherein the movement converting member comprises:

a rotating plate engaged with the fourth gear, a top surface of the rotating plate being sloped; and an ascending/descending bar located in the supporting pipe for raising and lowering the valve unit, a top end of the ascending/descending bar making contact with the plate of the valve unit and a bottom end of the ascending/descending bar making contact with the top surface of the rotating plate so that the ascending/descending bar may raise and lower from/to a lowest position of the top surface of the rotating plate to/from a highest position of the top surface of the rotating plate.

9. The apparatus of claim 7, wherein a sealing member is fixed to an interior of the guide for preventing water from flowing into the supporting pipe.

10. The apparatus of claim 9, wherein the ascending/descending bar comprises a rim being formed at the side surface thereof for raising and lowering the ascending/descending bar, and the rim being located at a position lower than the sealing member.

11. The apparatus of claim 10, wherein an elastic member is located between the sealing member and the ascending/descending bar for returning the ascending/descending bar to a normal position.

12. The apparatus of claim 1, wherein the water supply member comprises:

a first supply pipe interconnected with the outlet pipe of the second container;

a second supply pipe having a smaller sectional area than that of the first supply pipe, the second supply pipe extending from the first supply pipe to the ice tray so that the second supply pipe may guide water from first pipe to the ice tray; and a floater installed in the first supply pipe, the floater ascending by buoyancy such that when water is introduced into the first pipe, the floater raises and interconnect the first supply pipe and the second supply pipe with each other, and when water flows from the first supply pipe to the second supply pipe, the floater lowers and shuts the second supply pipe so as to prevent a cooling air from flowing from the refrigerating compartment to the freezing compartment.

13. The apparatus of claim 12, wherein a guider is installed in the first supply pipe for guiding the floater so that the floater raises and lowers directly above to the second supply pipe.

14. An apparatus for supplying water from a water tank to an ice tray, the water tank being provided in a refrigerating compartment of a refrigerator, the ice tray being provided in a freezing compartment of the refrigerator, the refrigerating compartment being positioned above the freezing compartment, the apparatus comprising:

a filter for filtering impurities of water contained in the water tank;

a first container for measuring a quantity of water, the first container having a same volume as the ice tray, the first container having an outlet port formed at a bottom surface thereof, the first container being rotatably installed below the water tank, and the outlet port being interconnected with a lower portion of the water tank;

a second container for supporting the first container which is installed in the freezing compartment, the second container including an outlet pipe which is formed at a bottom surface thereof which is interconnected with the outlet port of the first container when the first container is rotated;

a valve unit for opening and closing the lower portion of the water tank, the valve unit supplying an accurate amount of water from the water tank to the first container, the valve unit comprising: a shaft extending from the filter to an upper position of the first container, the shaft being raised and lowered; a plate formed at a bottom end of the shaft for opening and closing the lower portion the water tank; a stopper formed at a top end of the shaft for preventing the shaft from being parted from the filter; and an elastic member located between the filter and the plate;

a driving means for rotating the first container and at the same time ,for raising and lowering the valve unit, so that the driving means interconnects and shuts the outlet port of the first container and the outlet pipe of the second container with/from each other; and a water supply member installed in a partition wall which partitions off the freezing and refrigerating compartments, for flowing water from the outlet pipe of the second container to the ice tray, the water supply member comprising: a first supply pipe interconnected with the outlet pipe of the second container; a second supply pipe having a smaller sectional area than that of the first supply pipe, the second supply pipe extending from the first supply pipe to the ice tray so that the second supply pipe can guide water from the first pipe to the ice tray; a floater being installed in the first supply pipe, the floater ascending by buoyancy such that when water is introduced into the first pipe, the floater floats and interconnects the first supply pipe and the second supply pipe with each other, and when water flows from the first supply pipe to the second supply pipe, the floater sinks and shuts the second supply pipe so as to prevent a cooling air from flowing from the freezing compartment to the refrigerating compartment; and a guider is installed in the first supply pipe for guiding the floater to being ascended so that the floater raises and lowers directly above to the second supply pipe.

15. The apparatus of claim 14, wherein the driving means comprises:

a motor positioned in the refrigerating compartment and controlled by a controller;

a movement transmission member for rotating the first container by a driving force of the motor; and a movement converting member for changing a rotatory motion of the motor into a linear motion of the movement transmission member to raise and lower the valve unit.

16. The apparatus of claim 15, wherein the movement transmission member comprises:

a third gear engaged with the motor and the first container;

a fourth gear for rotating the movement converting member by the first gear being rotated; and a connecting shaft for connecting the third gear and the fourth gear with each other.

17. The apparatus of claim 16, wherein the movement converting member comprises: a rotating plate engaged with the fourth gear, a top surface of the rotating plate being sloped; and an ascending/descending bar located in the supporting pipe for raising and lowering the valve unit, a top end of the ascending/descending bar making contacts with the plate of the valve unit, and a bottom end of the ascending/descending bar making contacts with the top surface of the rotating plate so that the ascending/descending bar may raise and lower from/to a lowest position of the top surface of the rotating plate to/from a highest position of the top surface of the rotating plate.

* * * * *